US005292162A

United States Patent [19]

Korngold

[11] Patent Number: 5,292,162

[45] Date of Patent: Mar. 8, 1994

[54] RECEPTACLE CARRYING DEVICE

[76] Inventor: Sam Korngold, 2235 E. 24th St., Brooklyn, N.Y. 11229-4953

[21] Appl. No.: 862,222

[22] Filed: Apr. 2, 1992

[51] Int. Cl.[5] ..... B65D 25/32

[52] U.S. Cl. ..... 294/31.2; 220/758

[58] Field of Search ..... 294/27.1, 31.2, 33, 294/34, 137, 145, 149, 150, 153, 165, 167-169; 16/114 R; 215/100 A; 220/91, 92, 94 R, 94 A, 95, 96, 737, 738, 743, 752, 758-760, 769, 771, 773-776; 229/1.5 H

[56] References Cited

U.S. PATENT DOCUMENTS

| | | | |
|---|---|---|---|
| 415,984 | 11/1889 | Stern | 220/758 |
| 766,671 | 8/1904 | Crawford | 220/92 |
| 1,115,334 | 10/1914 | Penick | 220/92 |
| 1,425,417 | 8/1922 | Pruitt | 294/92 |
| 1,474,685 | 11/1923 | Parnell | 294/31.2 |
| 1,738,951 | 12/1929 | Hulbert | 220/776 X |
| 1,801,576 | 4/1931 | Shuger | 220/758 |
| 1,827,221 | 10/1931 | Burrows | 294/31.2 X |
| 2,602,687 | 7/1952 | Stanley | 294/31.2 |
| 2,743,129 | 4/1956 | Fredette | 294/31.2 |
| 2,792,958 | 5/1957 | Beyer | 294/31.2 X |
| 2,849,252 | 8/1958 | McLean | 294/31.2 |
| 2,888,179 | 5/1959 | Daggett | 215/100 A X |
| 3,275,366 | 9/1966 | Hidding | 294/31.2 |

FOREIGN PATENT DOCUMENTS

| | | | |
|---|---|---|---|
| 1947388 | 12/1978 | Fed. Rep. of Germany | 220/95 |
| 395154 | 2/1909 | France | 215/100 A |
| 1223402 | 6/1960 | France | 294/31.2 |

*Primary Examiner*—Johnny D. Cherry
*Attorney, Agent, or Firm*—Bruce L. Adams

[57] ABSTRACT

A carrying device is provided for a bucket-type receptacle having an open upper end with an outstanding rim thereabout. The carrying device consists of a ring which encompasses the bucket-type receptacle under the outstanding rim, a U-shaped handle to be gripped by a hand and a mechanism for attaching both ends of the U-shaped handle to the ring. The handle will extend upwardly above the open upper end of the bucket-type receptacle to be carried by the hand. The circumference of the ring is adjustable so as to allow use of the device with a variety of receptacle types.

5 Claims, 1 Drawing Sheet

RECEPTACLE CARRYING DEVICE

BACKGROUND OF THE INVENTION

The instant invention relates generally to container holders and more specifically it relates to a carrying device for a bucket type receptacle, which provides a handle removably attached under an outstanding rim of the bucket type receptacle, so that it can be carried therefrom.

There are available various conventional container holders which do not provide the novel improvements of the invention herein disclosed.

SUMMARY OF THE INVENTION

A primary object of the present invention is to provide a carrying device for a bucket type receptacle that will overcome the shortcomings of the prior art devices.

Another object is to provide a carrying device for a bucket type receptacle that includes a handle extending upwardly from a ring that is removably attached under an outstanding rim of the bucket type receptacle to be carried therefrom.

An additional object is to provide a carrying device for a bucket type receptacle in which the ring is adjustable, so that it can fit about different sized diameter bucket type receptacles to be carried.

A further object is to provide a carrying device for a bucket type receptacle that is simple and easy to use.

A still further object is to provide a carrying device for a bucket type receptacle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
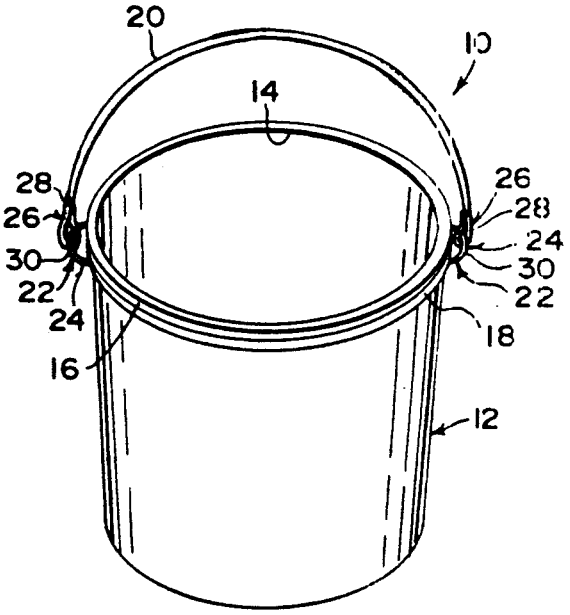
FIG. 1 is a perspective view of the instant invention showing a ring installed under an outstanding rim of a bucket type receptacle, so that the bucket type receptacle can be carried by a handle.
Figure 3:
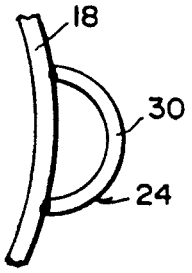
FIG. 3 is an enlarged top view of a portion of the ring showing the handle holder attached thereto.
Figure 2:
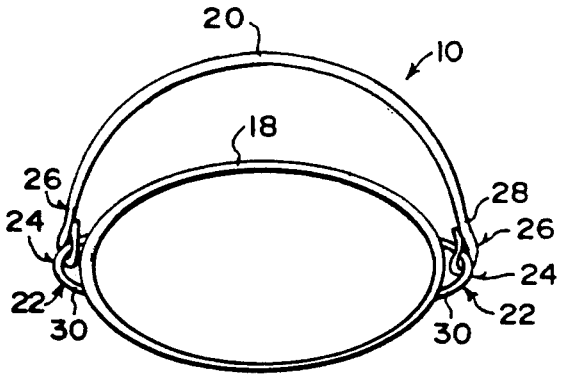
FIG. 2 is a perspective view of the instant invention per se.
Figure 4:
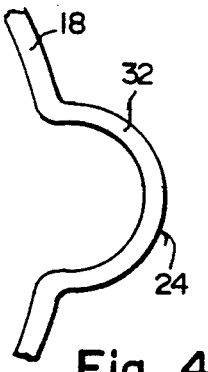
FIG. 4 is an enlarged top view of a portion of a modification showing the handle holder formed out of the ring.
Figure 5:
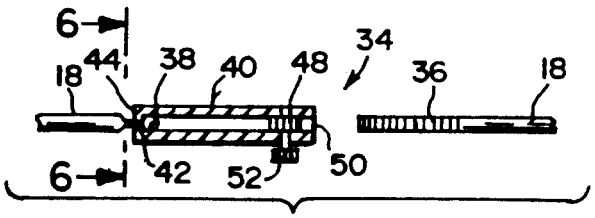
FIG. 5 is a side view partly in section of another modification showing an adjustment mechanism on the ring for changing the size of the ring for different sized diameter bucket type receptacles.

Turning now descriptively to the drawings, in which similar reference characters denote similar elements throughout the several views, the Figures illustrate a carrying device 10 for a bucket type receptacle 12 having an open upper end 14 with an outstanding rim 16 thereabout. The carrying device 10 consists of a ring 18 which encompasses the bucket type receptacle 12 under the outstanding rim 16. A U-shaped handle 20 is provided to be gripped by a hand, while a mechanism 22 is for attaching both ends of the U-shaped handle 20 to the ring 18. The handle 20 will extend upwardly above the open upper end 14 of the bucket type receptacle 12 to be carried by the hand.

The attaching mechanism 22 for each end of the handle 20 includes a handle holder 24 extending outwardly from the ring 18 and a connector 26 on one end of the U-shaped handle 20 to engage with the handle holder 24. The connector 26 is a loop 28 spot welded back onto the U-shaped handle 20. The handle holder 24 can be a C-shaped member 30 spot welded to the ring 18 to form an eye to retain the loop 28. The handle holder 24 can also be a C-shaped portion 32 formed out of the ring 18 to form an eye to retain the loop 28.

Figure 6:
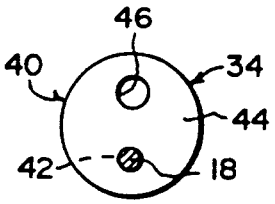
FIG. 6 is a cross sectional view taken along line 6—6 in FIG. 5 showing an aperture in the back part of the sleeve for the rack to exit therefrom when being adjusted.

As shown in FIGS. 1–4, the length of wire which constitutes the ring 18 is bent into a closed, non-overlapping ring shape. The two C-shaped members 30 curve radially outwardly from the ring 18 in the plane of the ring, and the ring 18 and C-shaped members 30 lie in a common horizontal plane. As depicted in FIG. 6, the wire 18 has a circular cross section.

The carrying device 10 further includes a structure 34 for adjusting the ring 18, so as to change the size of the ring 18 for different sized diameter bucket type receptacles 12. The adjusting structure 34 includes the ring 18 split with a rack 36 on one end and a ball 38 on another end. A sleeve 40 has a socket 42 on a first end 44 to receive the ball 38 with an aperture 46 in the first end 44 offset from the socket 42. A pinion 48 is rotatably mounted in the sleeve near a second open end. A control knob 52 extends from the pinion 48 transversely through the sleeve 40, when the rack 36 is inserted within the second open end 50 in the sleeve 40 and engages with the pinion 48. The control knob 52 can be turned to force the rack 36 through the aperture 46 in the first end 44 to change the diameter of the ring 18.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A device attachable to a container to enable carrying of the container, the device comprising: a closed, wire ring comprised of a length of wire bend into a closed, non-overlapping ring shape, the closed ring lying in a given plane and being dimensioned to slidably fit over the outside of a container and releasably engage with the container at the upper portion thereof, two generally C-shaped wire members spot welded to the wire ring at opposed locations from one another, the two C-shaped members being curved radially outwardly from the ring in the given plane of the ring, and a handle pivotably connected at opposite ends thereof to the two C-shaped members to permit the handle to pivot upwardly to a raised position above the top of the container to enable carrying of the container by the device.

2. A device according to claim 1; wherein the handle comprises an arcuate length of wire bent at each end thereof into a single loop encircling a respective one of the C-shaped members to thereby pivotally connect the handle to the two C-shaped wire members.

3. A device according to claim 2; wherein each single loop comprises an end portion of the handle wire bent downwardly around the outside of one C-shaped wire member with the end thereof bent upwardly through the inside of the C-shaped wire member into contact with the handle wire.

4. A device according to claim 3; wherein the end of each loop is spot welded to the handle wire to form a permanently closed loop to prevent detachment of the handle from the two C-shaped members.

5. A device according to claim 1; wherein the length of wire which defines the closed ring has a circular cross section.

* * * * *